US006105995A

United States Patent [19]

Zill

[11] Patent Number: 6,105,995

[45] Date of Patent: Aug. 22, 2000

[54] SNOWBOARD BINDING

[76] Inventor: Ken Zill, 1203 Lilienthal La., Redondo Beach, Calif. 90278

[21] Appl. No.: 09/054,014

[22] Filed: Apr. 2, 1998

[51] Int. Cl.[7] ..... A63C 9/00

[52] U.S. Cl. ..... 280/617; 280/624; 280/625; 280/14.2

[58] Field of Search ..... 280/607, 14.2, 280/617, 636, 613, 615, 633, 634, 619, 624, 625

[56] References Cited

U.S. PATENT DOCUMENTS

| | | | |
|---|---|---|---|
| 4,027,896 | 6/1977 | Frechin | 280/618 |
| 4,133,119 | 1/1979 | Kubelka | 280/613 X |
| 4,139,211 | 2/1979 | Salomon | 280/618 |
| 4,176,857 | 12/1979 | Bodendorfer | 280/613 |
| 4,410,199 | 10/1983 | Eisenberg | 280/615 |
| 4,741,550 | 5/1988 | Dennis | 280/618 |
| 4,746,139 | 5/1988 | Dimier et al. | 280/631 |
| 4,772,041 | 9/1988 | Klosterman | 280/611 |
| 4,871,186 | 10/1989 | Klosterman | 280/618 X |
| 4,920,665 | 5/1990 | Pack et al. | 280/613 |
| 5,035,443 | 7/1991 | Kincheloe | 280/618 |
| 5,114,172 | 5/1992 | Rousset et al. | 280/633 |
| 5,143,396 | 9/1992 | Shaanan et al. | 280/607 |
| 5,299,823 | 4/1994 | Glaser | 280/607 X |
| 5,398,957 | 3/1995 | Leighton et al. | 280/600 |
| 5,401,041 | 3/1995 | Jesperson | 280/14.2 |
| 5,505,477 | 4/1996 | Turner et al. | 280/613 |
| 5,544,909 | 8/1996 | Laughlin et al. | 280/41.2 |
| 5,560,633 | 10/1996 | McGowan | 280/607 X |
| 5,577,756 | 11/1996 | Caron . | |
| 5,669,630 | 9/1997 | Perkins et al. | 280/613 |
| 5,697,631 | 12/1997 | Ratzek | 280/613 |
| 5,722,680 | 3/1998 | Dodge | 280/14.2 X |
| 5,755,046 | 5/1998 | Dodge | 280/613 X |
| 5,799,957 | 9/1998 | Okajima et al. | 280/14.2 |
| 5,810,370 | 9/1998 | Covert et al. | 280/14.2 |
| 5,813,688 | 9/1998 | Dacklin | 280/607 |
| 5,813,689 | 9/1998 | Mansure | 280/607 |
| 5,826,891 | 10/1998 | Albrecht | 280/14.2 |
| 5,855,390 | 1/1999 | Hassell | 280/607 |
| 5,913,530 | 6/1999 | Berger et al. | 280/14.2 X |
| 5,918,897 | 7/1999 | Hansen et al . | 280/611 X |
| 5,927,744 | 7/1999 | Knapschafer | 280/14.2 X |
| 5,941,553 | 8/1999 | Korman | 280/613 |

FOREIGN PATENT DOCUMENTS

| | | | |
|---|---|---|---|
| 0318526 B1 | 2/1988 | European Pat. Off. . | |
| 4106401 | 9/1992 | Germany | 280/14.2 |
| 4311630-A1 | 8/1994 | Germany | 280/14.2 |

*Primary Examiner*—Michael Mar
*Assistant Examiner*—David E Herron, II

[57] ABSTRACT

A boot for use with a snowboard includes a binding for attachment to the boot. The boot includes a rigid lower and a flexible or rigid upper. The lower includes binding-receiving projections on the sides and heel. The lower includes notches at the sides that allow natural articulations of the foot while walking. The upper is fixedly attached to the lower. The binding includes a frame for attachment to the snowboard, a plurality of side engagement members to secure the front portion of the boot, and a heel engagement member for securing the rear portion of the boot. Hooks serve as side engagement members that receive the boot side projections. A bail and lever engage the boot at the heel projection.

4 Claims, 12 Drawing Sheets

SNOWBOARD BINDING

BACKGROUND

1. Field of Invention

The present invention relates generally to bindings for sports equipment and more particularly, to sport boots and bindings for releaseable attachment to snowboards and the like.

2. Description of Prior Art

A snowboard is an elongated, monolithic board with at least one upturned end. Bindings secure a snowboarder's boots to the snowboard. Normally, the snowboarder's boots are oriented generally transverse or at an angle to the longitudinal axis of the snowboard. The snowboarder's stance is similar to that of a skateboarder or surfer.

A snowboard is controlled by the snowboarder's weight transfer, foot movement, and balance. It is important for the snowboarder's foot to be held securely in contact with the top surface of the snowboard. Any foot movement within the boot or binding could have a significant effect on the snowboarder's ability to control the snowboard.

Also desirable, is a close distance from the bottom of the snowboarder's feet to the top surface of the snowboard, thus providing a lower center of gravity for the snowboarder, which allows increased balance and control of the snowboard.

Often a snowboarder must hike or walk great distances to the snowboarding destination. It is desirable to have a boot that is comfortable for snowboarding as well as walking and hiking.

Also desirable, is a binding that is light in weight. A lighter weight binding contributes to an increase in snowboarder control and maneuverability of the snowboard.

It is also desirable to have a binding that allows both quick and easy entries and exits of the boots. A snowboarder must remove the rear boot from its binding in order to use the ski lift, and must remove both boots in order to hike up the mountain. Thus, it is desirable for the rider to spend time snowboarding rather than entering or exiting the binding.

Current snowboard bindings are of three major categories: soft boot and buckle bindings, plate bindings, and step-in bindings.

The soft boot and buckle bindings have: rigid bases attached to the snowboard, rear leg supports, straps to wrap around the boot, and buckles to secure the straps in place. The soft boots, when removed from the bindings, are either standard insulated snow boots, or slightly modified snow boots. The soft boots generally have light weight, and offer a close distance from the foot to the snowboard top surface, have few moving parts, are comfortable and are easy to walk and hike in, and are simple and cost effective to manufacture. However, the buckle binding makes it difficult to eliminate boot movement within the binding, which produces a loss of edge control. A snowboarder may attempt to gain more edge control by tightening the binding straps around the boots. However, such overtightening can seriously sacrifice foot comfort. In addition, the buckle binding can make entries and exits time consuming and cumbersome.

In an effort to add more edge control, mountaineering-type boots have been used with plate bindings. These boots include a molded plastic, stiff outer shell and a soft inner liner, similar to ski boots. The boots then mount on the snowboard using plate bindings. Plate bindings have both heel and toe bails that attach to associated heel and toe sole extensions that secure the boot in place. These bindings offer virtually no foot movement within the boot or binding, thus good edge control ability for the snowboarder. Also, these bindings have few moving parts that can malfunction, are simple and cost effective to manufacture, and allow quick and easy entries and exits. Also, the plate binding pulls the boot tight to the binding base. Boot tread wear does not lessen the desired tight contact with the binding base. However, due to the rigid plastic shell, the boots generally feel uncomfortable during snowboarding. Also, due to the need for a rigid sole from heel to toe, walking and hiking is both difficult and uncomfortable. Although the binding is relatively light in weight, the boot is relatively much heavier than other types of boots.

Step-in bindings have recently emerged to address the need for a binding with increased edge control, soft boot comfort, and quick and easy entry and exit. Most step-in bindings have a soft boot upper with a rigid sole from heel to toe. Incorporated into the bottom of the sole is an attachment member. The binding base, which is attached to the snowboard, includes a mechanism that engages this boot sole attachment member. Most step-in bindings offer foot comfort while snowboarding, good edge control ability, and generally quick and easy entry and exit. However, due to the rigid sole, walking and hiking remains both difficult and uncomfortable. Also, because the binding attachment is generally made part of the sole of the boot, the distance the snowboarder's foot is from the top surface of the snowboard is significantly increased, pushing the snowboarder's center of gravity higher. In addition, many step-in bindings require complicated attachment mechanisms, such as springs and cams, that make malfunctions more likely. Also, since many of the attachment mechanisms are recessed into the bottom of the boot sole, they may be susceptible to clogging with ice or snow, making entry and exit into the binding difficult. In addition, most step-in boot attachments rest on top of the engaging mechanism incorporated into the binding. Boot tread wear or binding parts wear could result in a gap between the boot and the binding base, thus resulting in a lack of direct contact of the boot to the snowboard. This effect could result in undesirable foot movement of the boot and a reduction of snowboarder edge control.

OBJECTS AND ADVANTAGES

Accordingly, several objects and advantages of the present invention are:

(a.) to provide a snowboard binding that provides no foot movement within the boot or binding, resulting in improved edge control for the snowboarder;

(b.) to provide a snowboard binding, that offers improved foot comfort while snowboarding;

(c.) to provide a snowboard binding that offers quick and easy entry and exit;

(d.) to provide a snowboard binding that allows a boot that offers comfort and ease when hiking and walking;

(e.) to provide a snowboard binding that offers a close distance from the snowboarder's foot to the top surface of the snowboard, resulting a lower center of gravity for the snowboarder;

(f.) to provide a snowboard binding that is light in weight;

(g.) to provide a snowboard binding that has few moving parts that could malfunction;

(h.) to provide a snowboard binding that allows reasonable wear of the boot sole tread and binding parts, without effecting the secure tight contact to the top of the binding base;

(i.) to provide a snowboard binding without mechanisms that can clog with snow and ice; and (j.) to provide a snowboard binding that is simple and cost effective to manufacture.

Further objects and advantages will become apparent from a consideration of the ensuing descriptions and drawings.

DRAWING FIGURES

In the drawings, closely related figures have the same number but different alphabetic suffixes.

FIGS. 10A through E are side views of the boot and binding during attachment and use.

Figure 11:
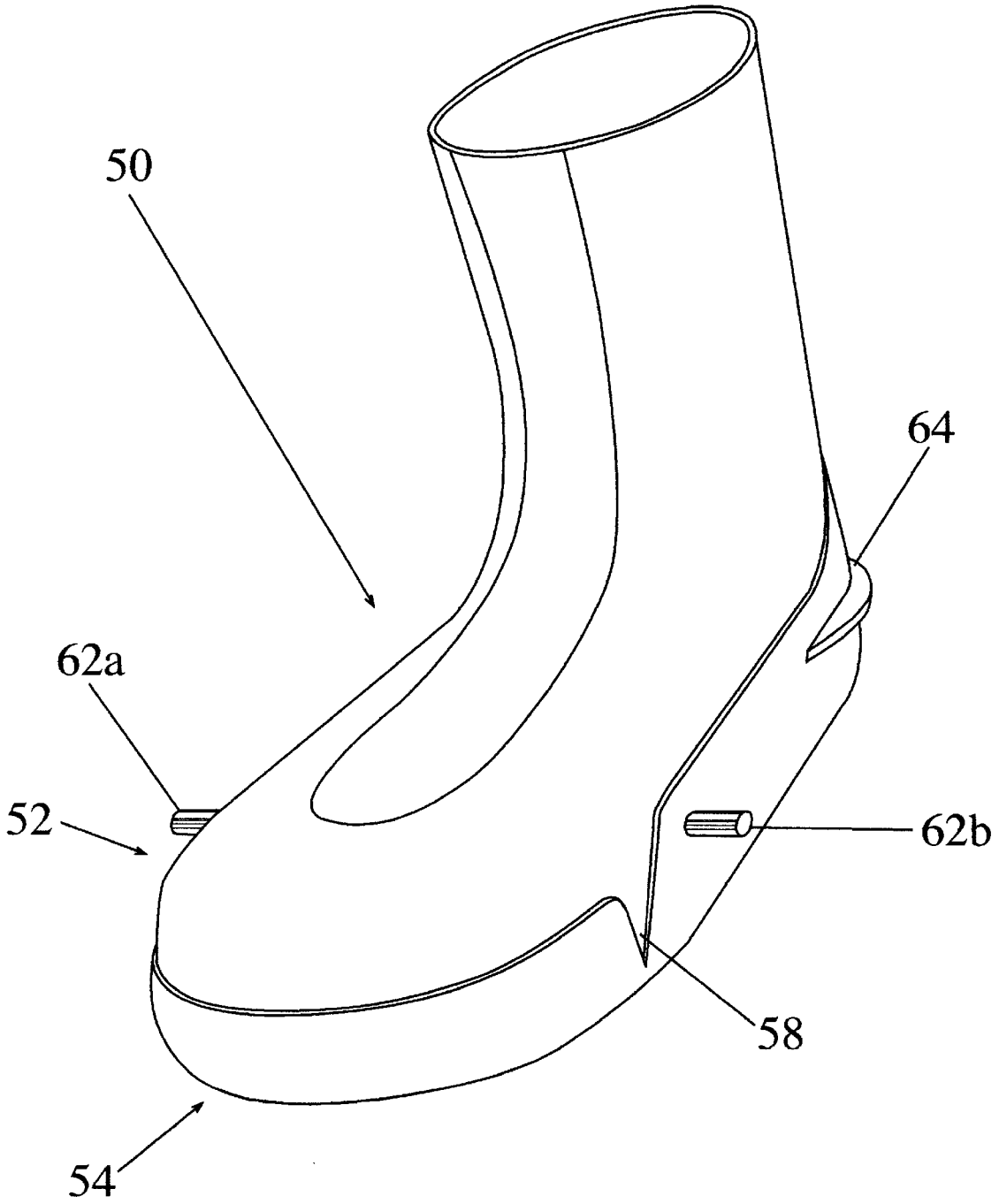

FIG. 11 is a perspective view of another embodiment of the boot.

Figure 12:
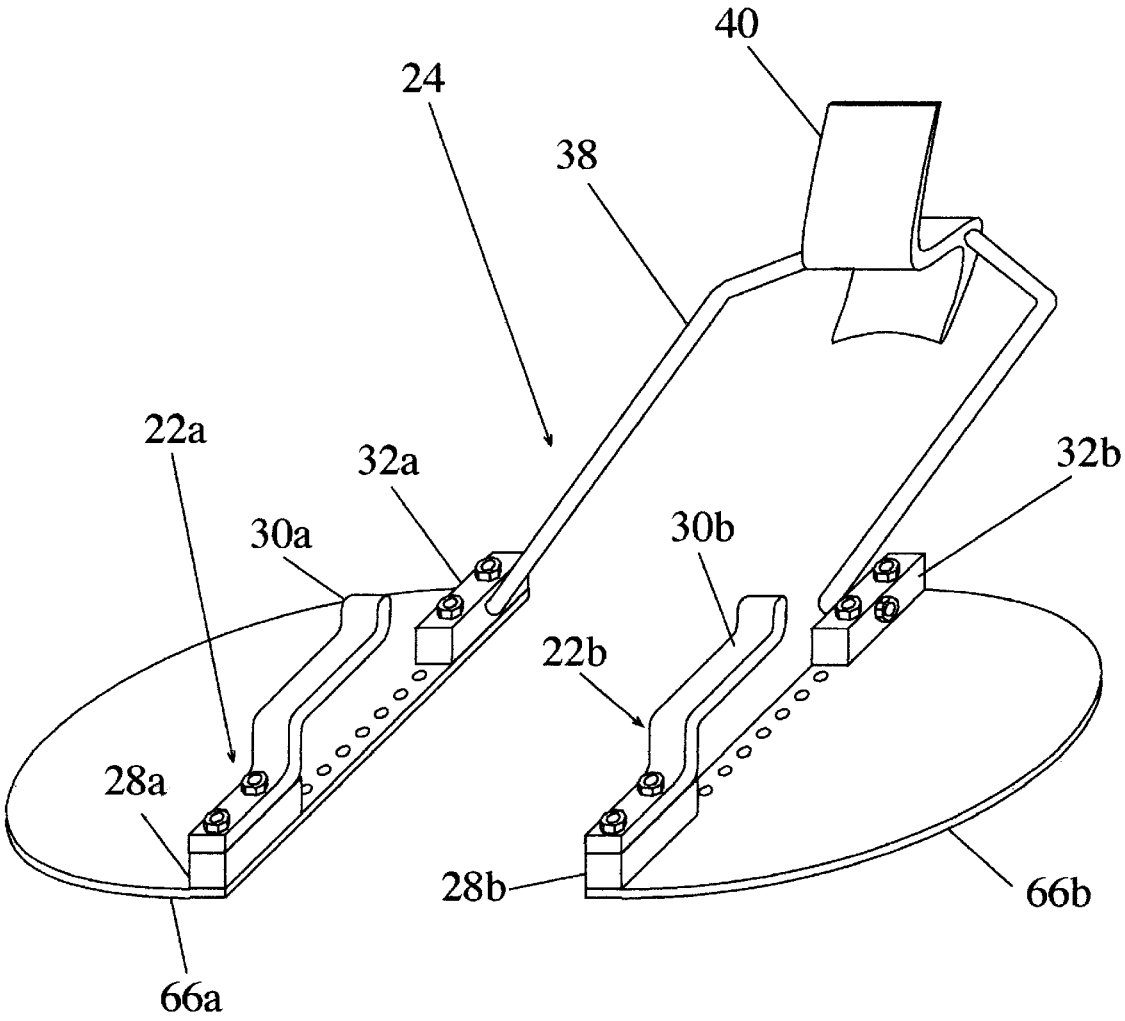

FIG. 12 is a perspective view of another embodiment of the binding.

REFERENCE NUMERALS IN DRAWINGS

10 snowboard

20 binding

22 binding side engagement assembly

24 binding heel engagement assembly

26 binding frame

28 spacer

30 restraining hook

32 heel engagement assembly mounting block

38 bail

40 heel lever

50 boot

52 boot upper

54 boot lower

56 tread

58 flex notch

60 side projection

62 side projection peg

64 heel projection

66 baseless binding frame

SUMMARY

In accordance with the present invention a snowboard binding comprises a boot attached to a binding at the sides and at the heel.

DESCRIPTION

FIGS. 1–12

Figure 1:
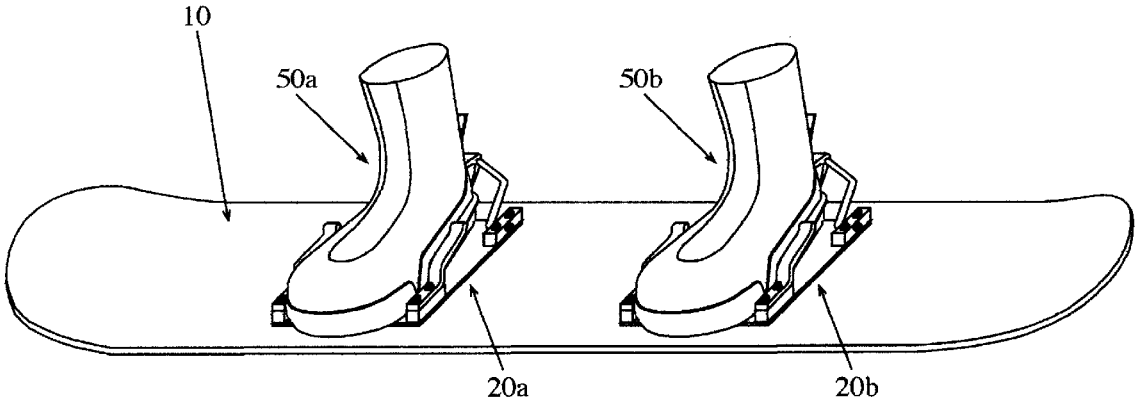
FIG. 1 is a perspective view of one embodiment of the snowboard boots and bindings, showing the boots attached to the snowboard with the bindings.
Figure 2:
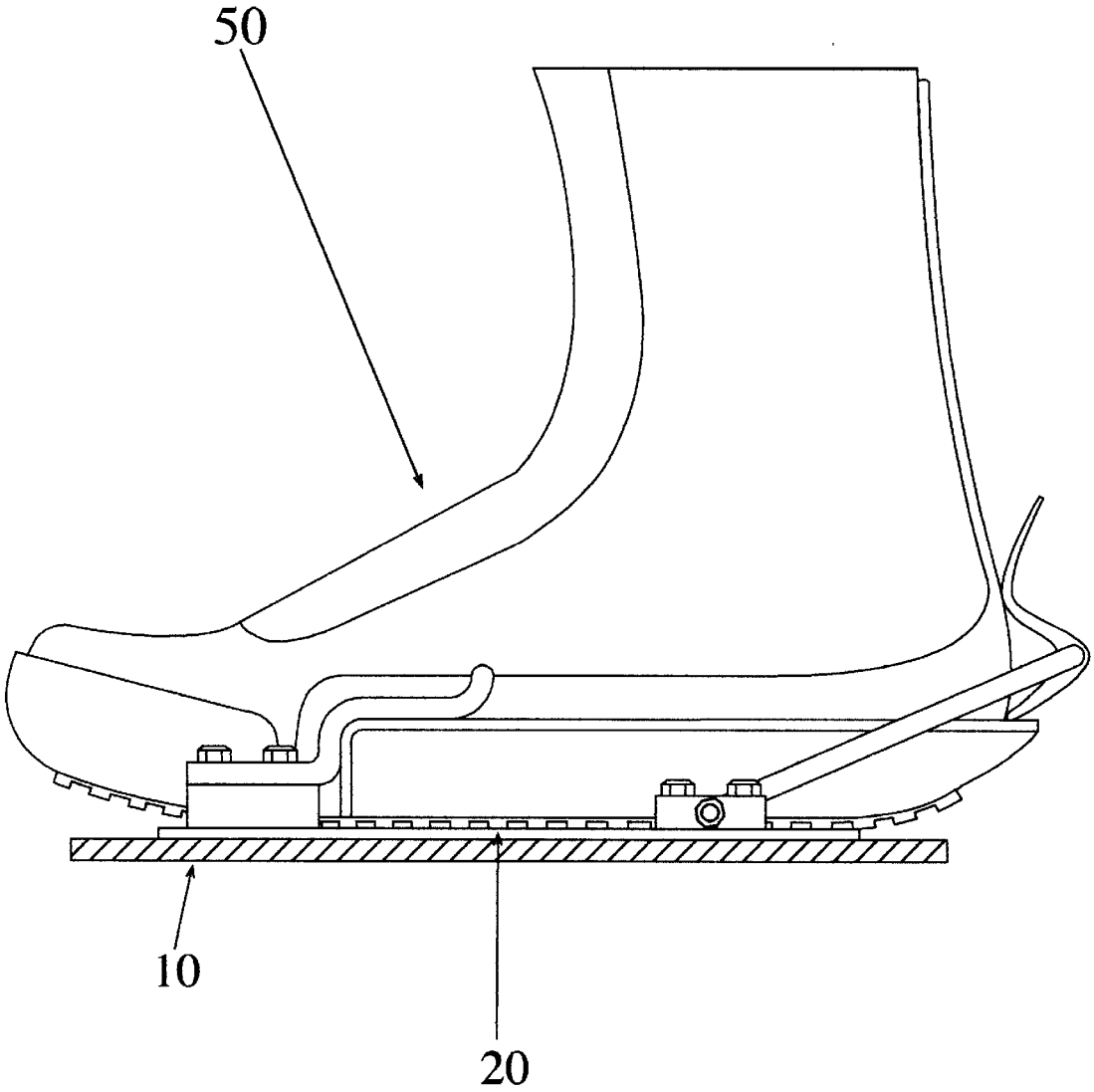
FIG. 2 is a side view of the boot attached to the binding.

FIGS. 1 and 2 show perspective and side views of a preferred embodiment of the present invention, attached to a snowboard in ready-to-ride position. A pair of binding assemblies (20*a,b*) attach to a snowboard (10) using suitable fasteners. A pair of boots (50*a,b*) engage with binding assemblies (20*a,b*). Because the two boots (50*a,b*) and the two bindings (20*a,b*) have substantially the same construction, for ease of explanation, only one boot (50*a*) and one binding (20*a*) appear in detailed descriptions.

Figure 3:
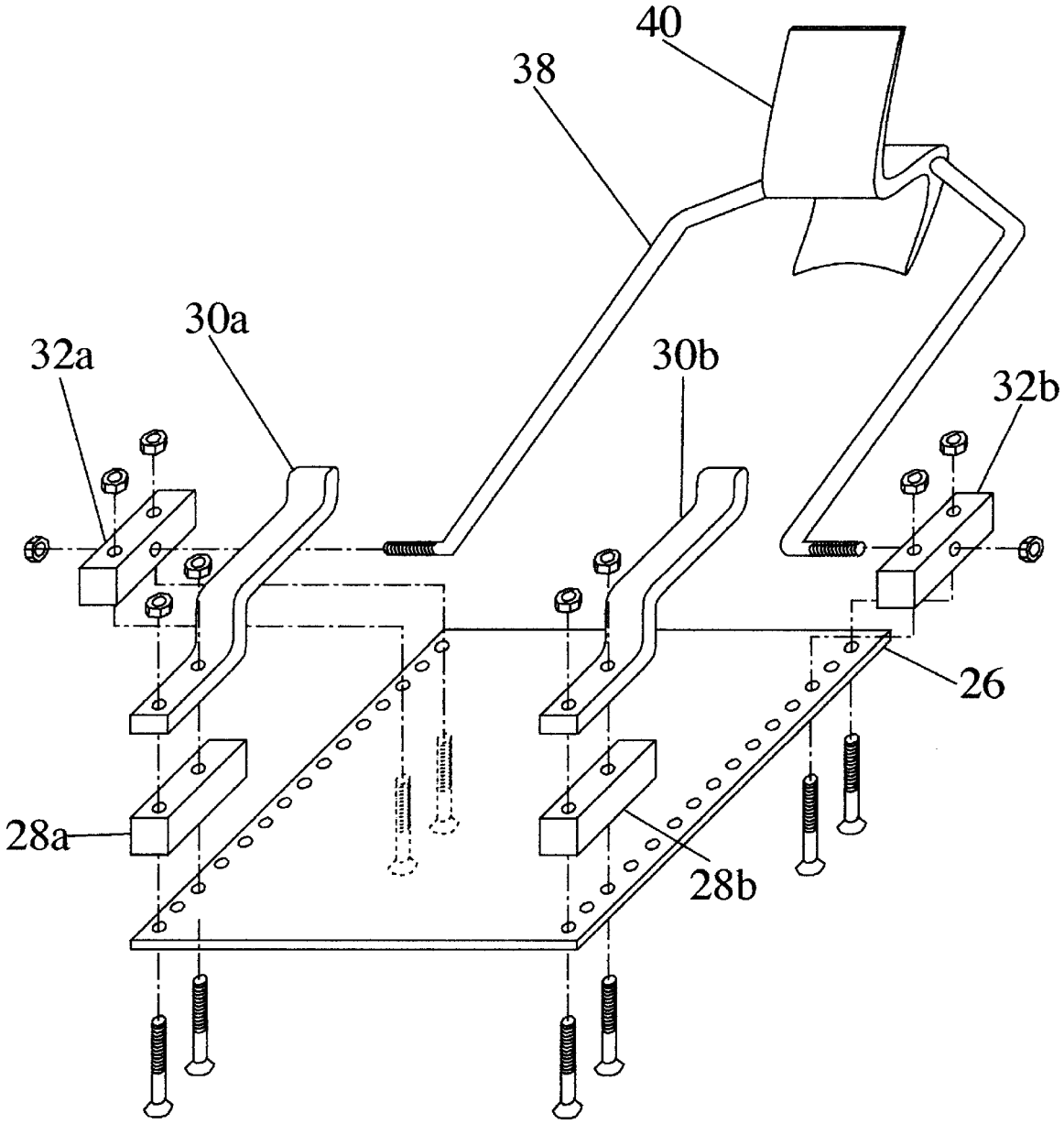
FIG. 3 is an exploded view of the binding.
Figure 4:
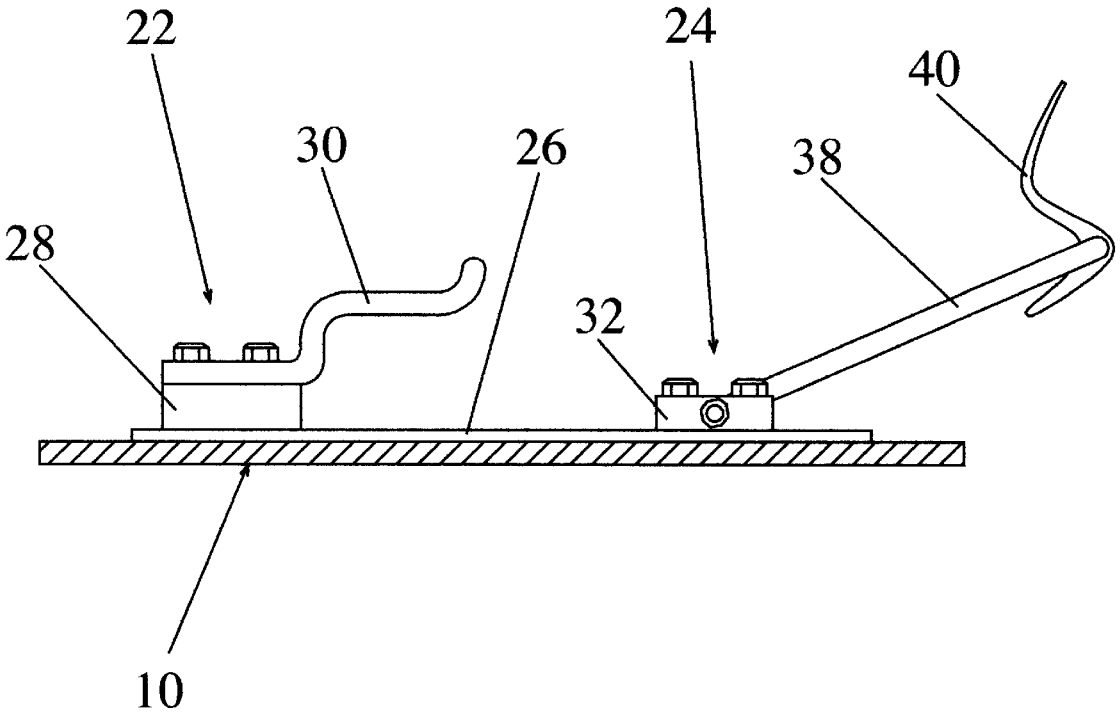
FIG. 4 is a side view of the binding.
Figure 5:
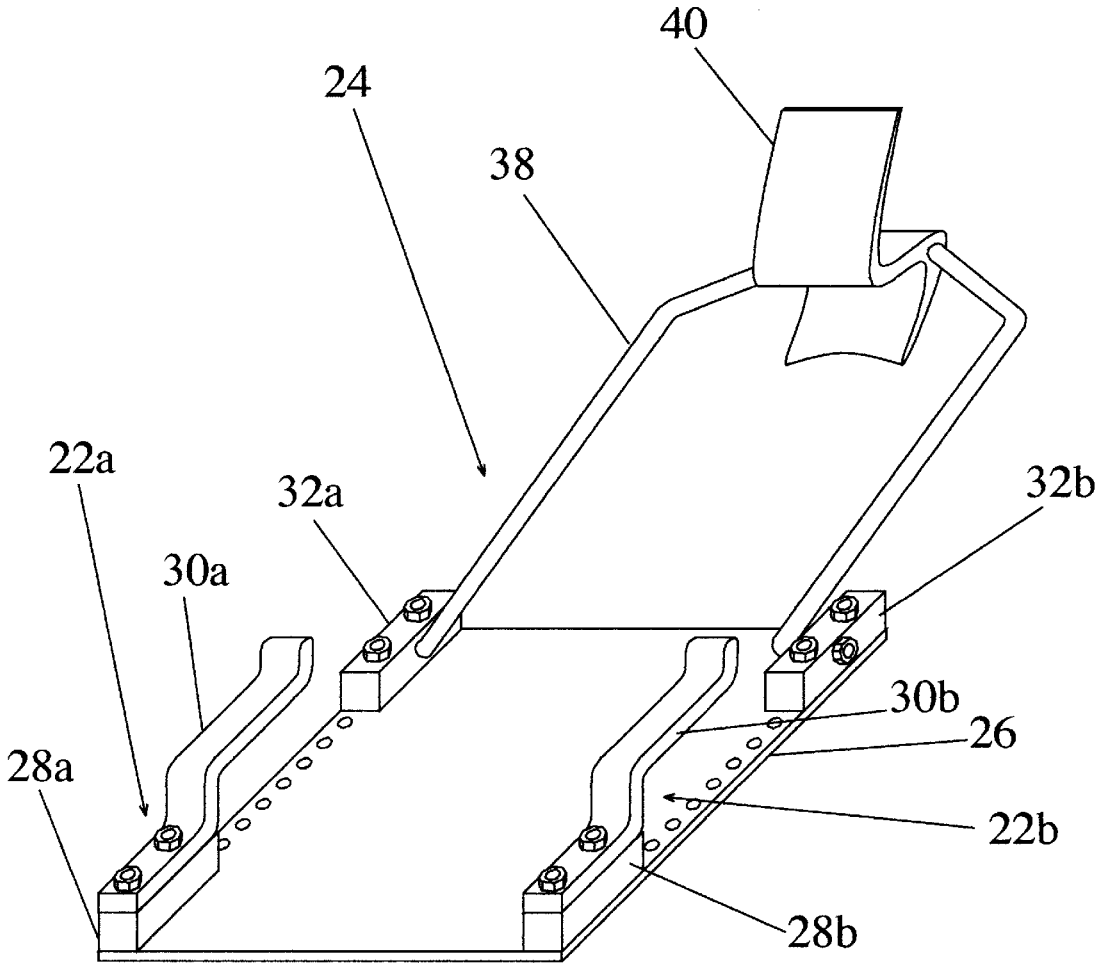
FIG. 5 is a perspective view of the binding.

FIGS. 3, 4, and 5 show exploded, side and perspective views of a preferred embodiment of the binding assembly (20*a*). The binding assembly (20*a*) includes a binding frame (26), left and right binding side engagement assemblies (22*a,b*), and a binding heel engagement assembly (24*a*). Binding frame (26) attaches to snowboard (10) using suitable fasteners e.g. screws, positioned generally transverse to the longitudinal axis of the snowboard (10). As will be appreciated, the binding frame (26) can be rotatably adjusted to the rider's preference. Binding frame (26) is of a strong, rigid material e.g. steel, aluminum, plastic, or reinforced plastic. FIG. 12 shows a perspective view of an alternative binding frame, that has baseless binding frames (66*a,b*). Baseless binding frames (66*a,b*) are of a strong rigid material e.g. steel, aluminum, plastic, or reinforced plastic and are mounted to snowboard (10) using suitable fasteners e.g. screws. Binding side engagement assemblies (22*a,b*) are attached to the front area of the binding frame (26) using suitable fasteners e.g. screws or a nuts and bolts arrangement. Binding side engagement assemblies (22*a,b*) can be adjustably positioned on the binding frame (26) to account for different boot sizes. The binding side engagement assemblies (22*a,b*) include spacers (28*a,b*), and restraining hooks (30*a,b*). Spacers (28*a,b*) are of a strong, rigid material. As will be appreciated, the spacers (28*a,b*) can be any other suitable device that can adjust the height of the restraining hooks (30*a,b*), e.g. washers or compression springs. Placed on top of the spacers (28*a,b*) are restraining hooks (30*a,b*). Restraining hooks (30*a,b*) are aft-opening hooks positioned with the open side of the hook facing towards the rear or heel area of the binding frame (26). Restraining hooks (30*a,b*) are of a strong, rigid material e.g. steel, aluminum, plastic, or reinforced plastic.

A binding heel engagement assembly (24) attaches to the aft area of binding frame (26) using suitable fasteners e.g. screws or a nuts and bolts arrangement. The binding heel engagement assembly (24), can be adjustably positioned on the binding frame (26), to account for different boot sizes. The binding heel engagement assembly (24) includes a pair of heel engagement assemly mounting blocks (32*a,b*), a bail (38), and a heel lever (40). The heel engagement assembly mounting blocks (32*a,b*) attach to the binding frame (26) using suitable fasteners e.g. screws or a nuts and bolts arrangement. The heel engagements assembly mounting blocks are of a strong, rigid material e.g. steel, aluminum, plastic, or reinforced plastic. The bail (38) pivotally mounts to the rearward assembly mounting blocks (32*a,b*), using suitable fasteners e.g. screws or a nuts and bolts arrangement. The bail (38) is of a strong, rigid material e.g. steel or aluminum. The heel lever (40) pivotally mounts to the bail (38). The heel lever (40) is of a strong, rigid material e.g. steel, aluminum, plastic, or reinforced plastic.

Figure 6:
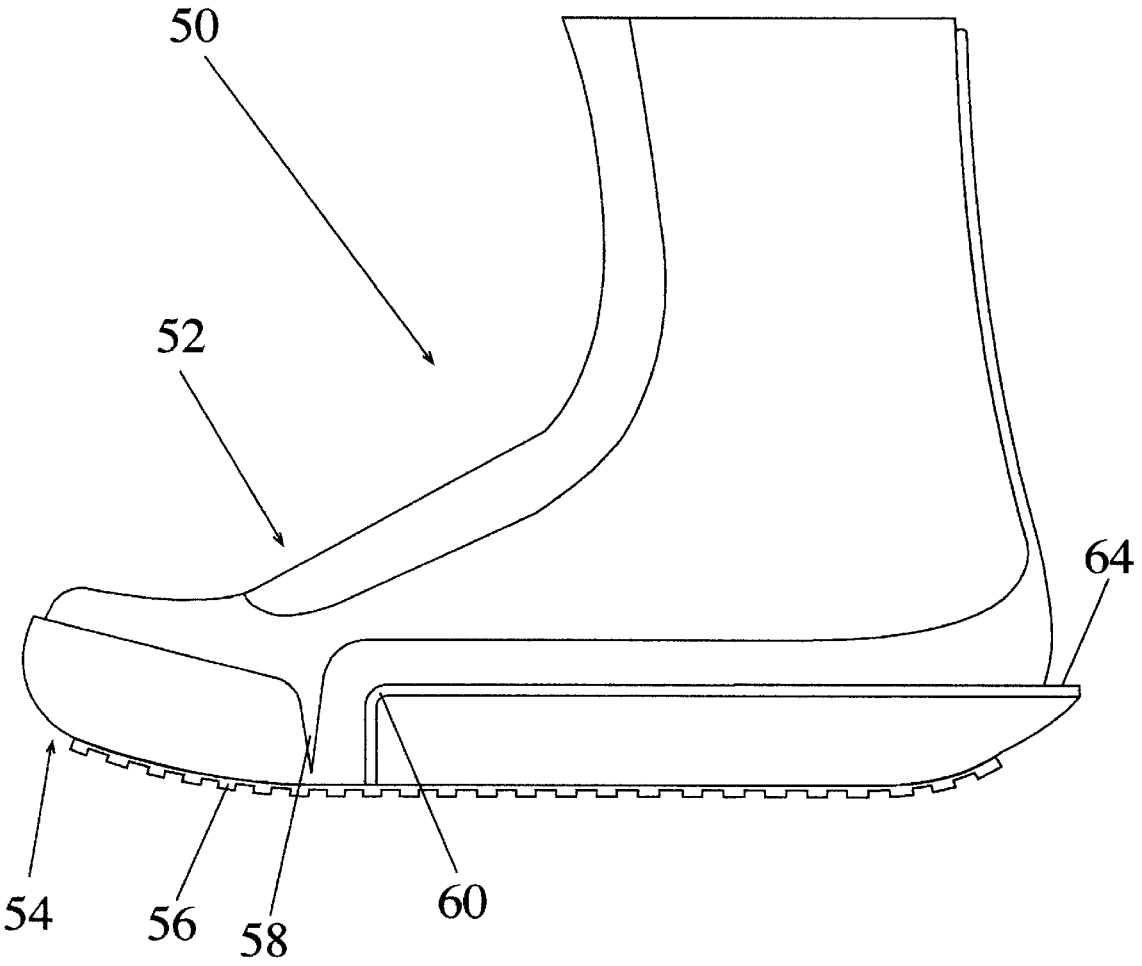
FIG. 6 is a side view of the boot.
Figure 7:
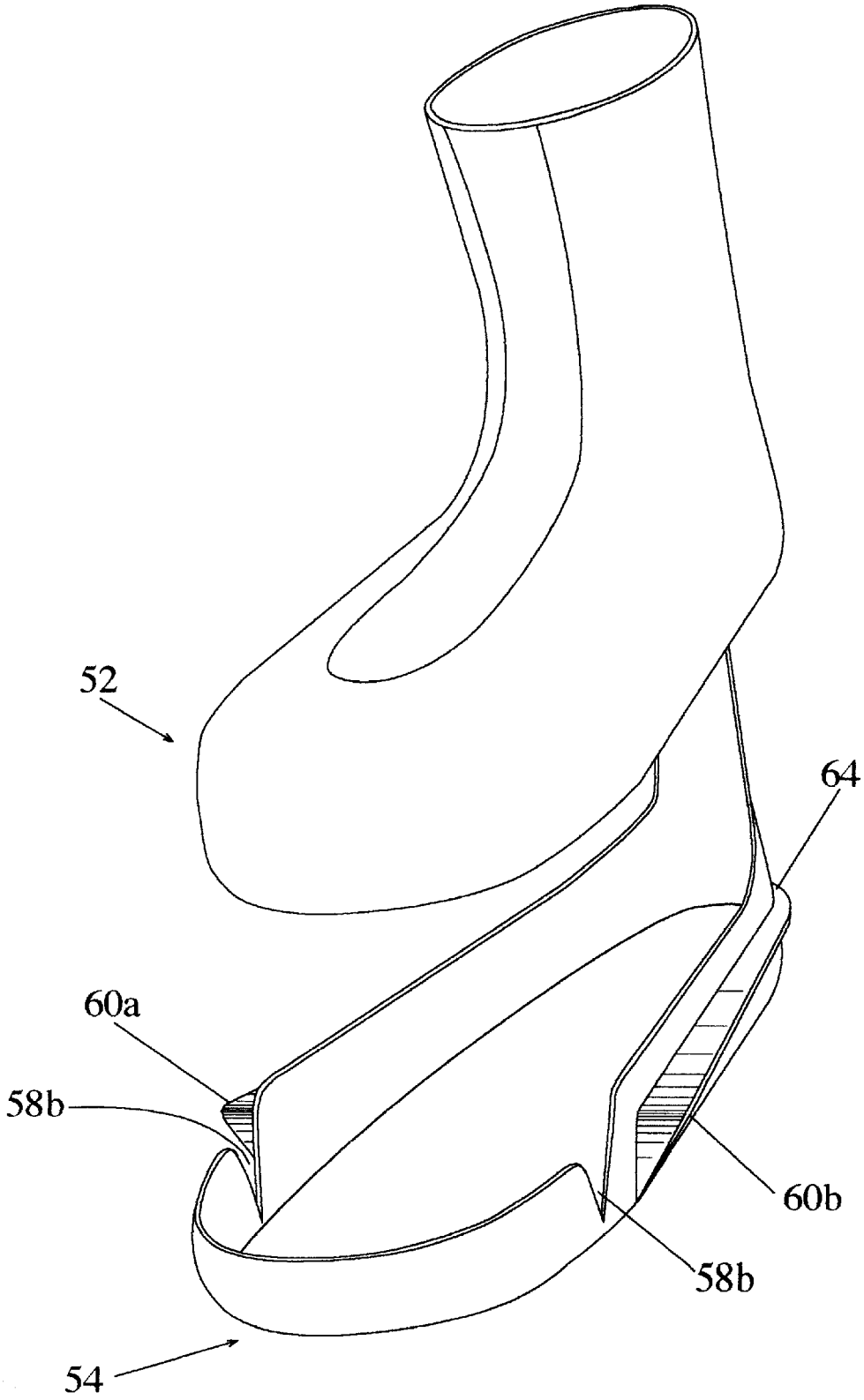
FIG. 7 is an exploded view of one embodiment of the boot.
Figure 8:
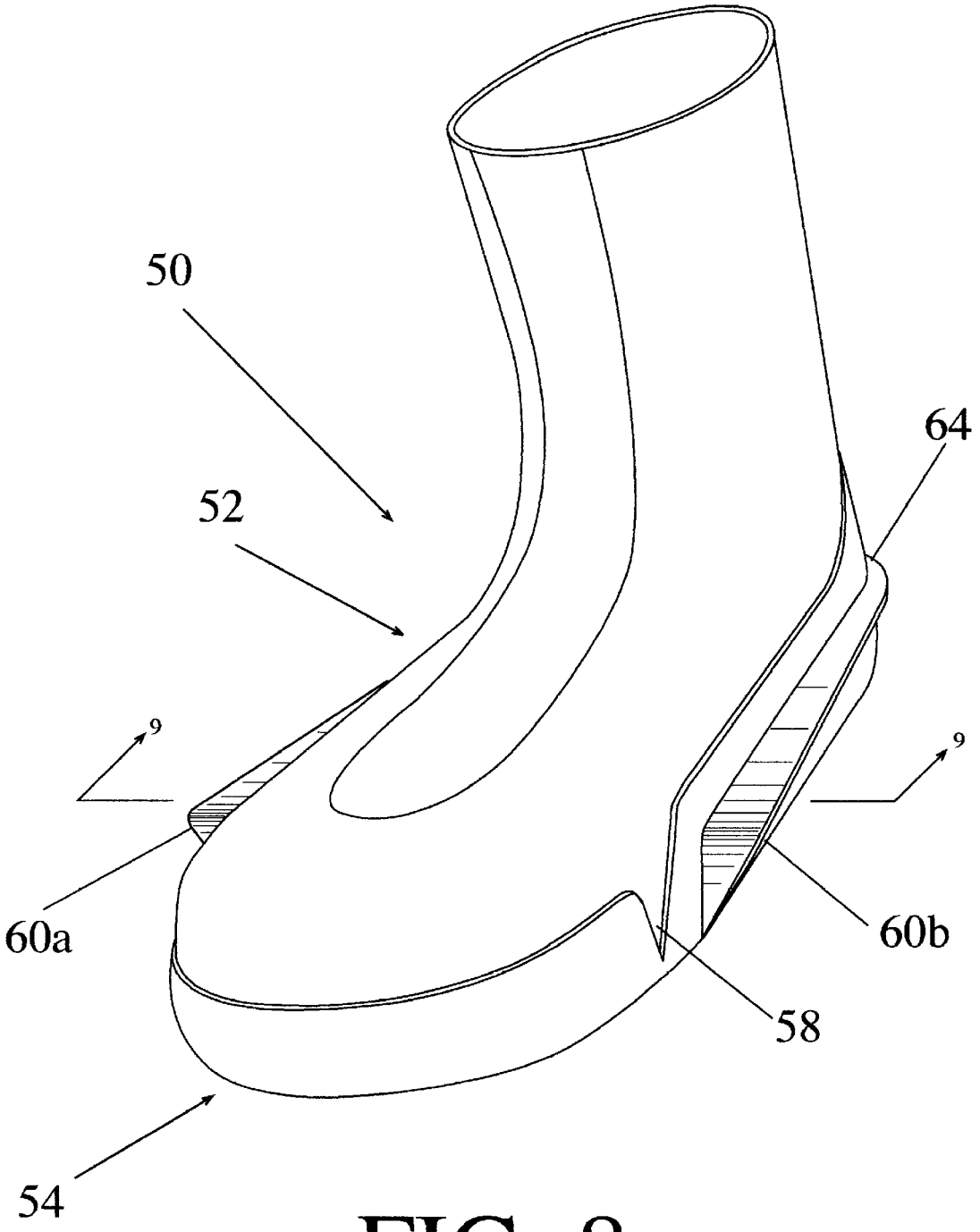
FIG. 8 is a perspective view of one embodiment of the boot.
Figure 9:
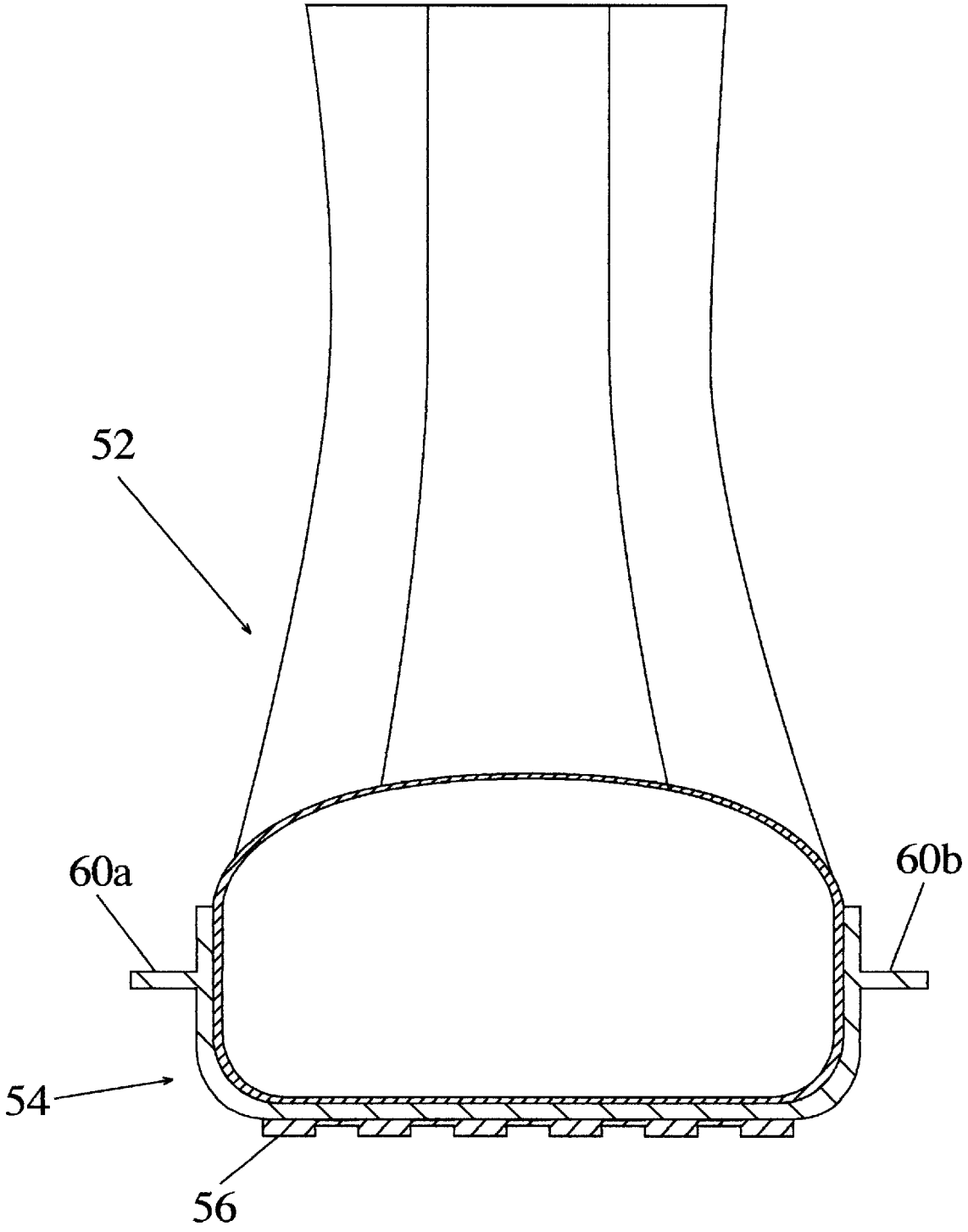
FIG. 9 is a cross-sectional view of the boot taken along lines 9—9 of FIG. 7.

FIGS. 6–8 show side, exploded, and perspective views of preferred embodiment of the boot (50). FIG. 9 shows a cross-sectional view of boot (50) taken at lines 9—9 of FIG.

8. The boot (50) includes a boot upper (52), a boot lower (54), and a tread (56). The boot upper (52) attaches to the boot lower (54) by any suitable method e.g. stitching or glue, or a combination of the two. The tread (56) attaches to the bottom of the boot lower (54) by any suitable method e.g. stitching or glue, or a combination of the two. In the preferred embodiment, the boot upper (52) is of a strong, flexible, non-stretchable material e.g. nylon fabric, or leather. However, it is understood by those skilled in the art that any material, or combination of materials rigid or flexible, could be used. As will be appreciated, the boot upper (52) and the boot lower (54) can be combined into one unit of a strong, rigid, or semi-rigid material e.g. plastic or reinforced plastic, similar in construction to that of a ski boot. The boot lower (54) includes a pair of flex notches (58*a,b*), a pair of side projections (60*a,b*), and a heel projection (64). The boot lower (54) is of a strong rigid material e.g. plastic or reinforced plastic. The boot lower (54) wraps around the lower area of the boot and supports the foot. A flex notch (58*a,b*) is located on the sides of the boot lower (54), positioned approximately at the ball, or wide point of the foot, and allows the boot lower (54) to bend along the foots natural articulation. The side projections (60*a,b*) are positioned just aft of the flex notches (58*a,b*), substantially located at the wide-point of the boot lower and project outward from the sides of the boot lower (54). Side projections (60*a,b*) are of a strong, rigid material. Side projections (60*a,b*) can be molded into the boot lower (54) or attached using suitable fasteners e.g. screws or a nuts and bolts arrangement. FIG. 11 shows an alternative embodiment of the boot (50) with side projection pegs (62*a,b*). Side projections pegs (62*a,b*) project outward from the sides of the boot lower (54). Side projection pegs (62*a,b*) can be molded into the boot lower, or as a separate piece attached to the boot lower (54) using suitable fasteners e.g. screws or a nuts and bolts arrangement. The heel projection (64) is positioned on the back of the heel section of the boot lower (54) and projects outward. The heel ledge (64) is of a strong, rigid material. The heel projection (64) can be molded into the boot lower (54) or attached using suitable fasteners e.g. screws or a nuts and bolts arrangement. The tread (56) is designed to provide traction when walking or hiking in the boot (50). The tread (56) is of a resilient, flexible material e.g. rubber or plastic, similar to that of a hiking boot.

OPERATION

FIGS. 10A–10E

Figure 10A:
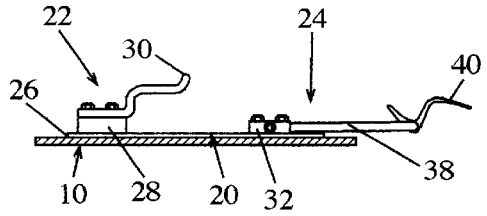
Figure 10B:
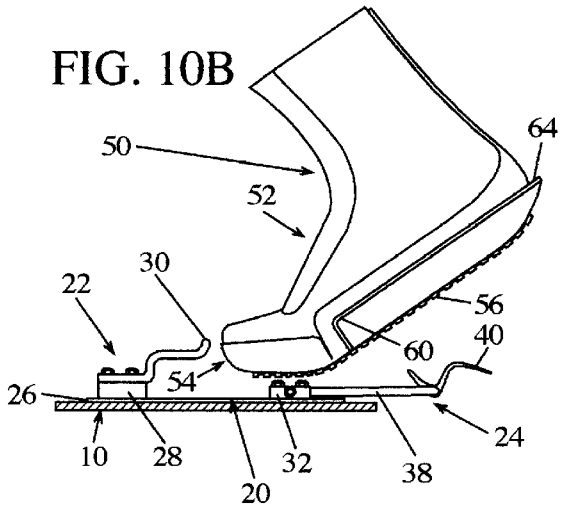
Figure 10C:
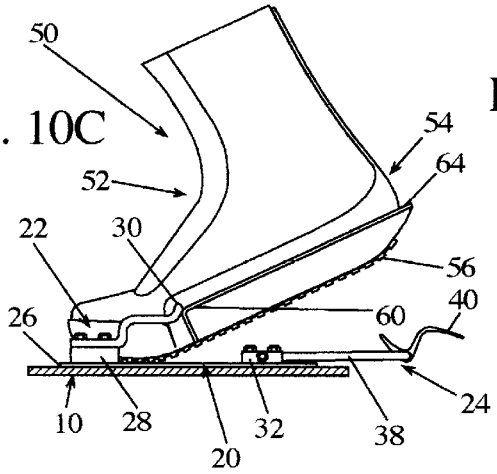
Figure 10D:
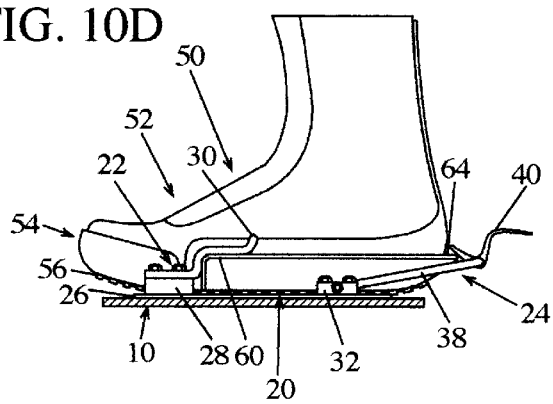
Figure 10E:
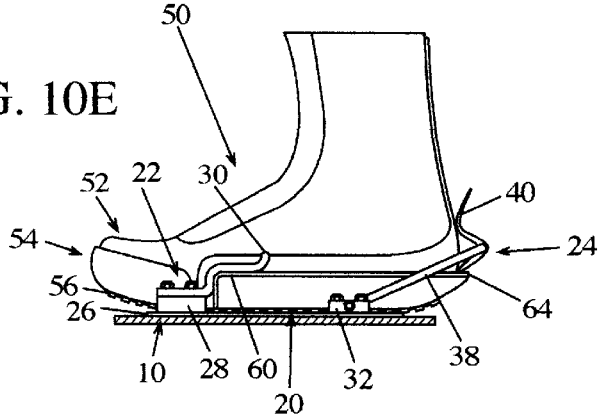

FIGS. 10A–10E show a side view of the boot (50) attaching to the binding (20). FIG. 10A shows the binding (20) in ready-to-mount position. FIG. 10B shows the boot (50) placed lengthwise within the binding frame (26). FIG. 10C shows the side projections (60*a,b*) of the boot (50) sliding underneath the restraining hooks (30*a,b*). FIG. 10D shows the boot (50) with side projections (60*a,b*) fully engaged in the restraining hooks (30*a,b*). In the position shown in FIG. 10D, the boot (50) cannot move upward or forward, it can only slide backward. FIG. 10D also shows the heel lever (40) positioned on the heel ledge (64). FIG. 10E shows the heel lever (40) flipped upward, putting pressure on heel ledge (64), pulling the boot (50) down towards the binding frame (26) and in towards the middle of the binding (20). FIG. 10E shows the boot (50) fully engaged in the binding (20). In the position shown in FIG. 10E, the boot (50) cannot move in any direction; it is fully constrained in the binding (20).

To release the boot (50) from the binding (20), the heel lever (40) is pressed downward, releasing the rearward portion of the boot (50). The boot (50) can then slide backward, releasing the side projections (60*a,b*) from under the restraining hooks (30*a,b*), and free the boot (50) from the binding (20).

SUMMARY, RAMIFICATIONS, AND SCOPE

Accordingly, the reader will see my invention provides a snowboard binding that

- secures the foot comfortably, allowing no foot movement, allowing the greatest amount of edge control of the snowboard;
- allows quick entry and exit, reducing the time taken away from snowboarding;
- allows a more comfortable boot for walking and hiking, as well as riding;
- allows the foot to be as close to the board as possible, resulting in a lower center of gravity for the snowboarder, thus greater control of the snowboard;
- allows a lightweight boot and binding, resulting in increased maneuverability of the snowboard;
- allows a simple binding attachment with few moving parts, reducing possibility of malfunction;
- allows the binding to adjust to compensate for tread wear on the boot, insuring a secure, tight contact with the snowboard;
- allows a boot and binding that cannot clog with snow or ice, insuring proper engagement;
- allows a snowboard binding that is simple and cost effective to manufacture, thus affordable for the consumer.

Although my above description contains many specifications, these should not be construed as limitations on the scope of the invention, but rather as an exemplification of one preferred embodiment thereof. Many other variations are possible. Accordingly, the scope of the invention should be determined not by the embodiments illustrated, but by the appended claims and their legal equivalents.

What is claimed is:

1. A snowboard boot binding system comprising a binding which is secured to a snowboard, and a boot which is secured to said binding;

said boot comprising an upper portion, a lower portion, said lower portion comprising:

a. a toe portion;

b. a wide-point portion;

c. an instep portion;

d. a heel portion, comprising a heel attachment member, said heel attachment member projecting outward;

e. left and right side portions, comprising left and right side attachment members, said left and right side attachment members projecting laterally outward from said boot wide-point portion; said binding comprising a binding frame for attachment to a snowboard, said binding frame comprising:

a. a front portion;

b. a rear portion, comprising a heel engagement means for receiving said boot heel attachment member, said heel engagement means having an open and a closed position, thereby when the boot heel attachment member is engaged with said binding heel engagement means in the closed position, the boot is prevented from raising upward, moving backward, and moving to either side;

c. left and right side portions, comprising left and right side engagement means for receiving the boot left and right side attachment members, with said boot wide point portion extending therebetween, said binding left and right side engagement means comprising left and right side aft opening hook engagement members with upwardly and rearwardly extending portions, an aft opening being formed between each rearwardly extending portion and a base plate of the binding, said boot left and right side attachment members are inserted into the aft openings of the hook engagement members and moved forwardly into a fully engaged position within said binding left and right side aft opening hook members for preventing the boot from raising upward, moving forward, and moving to either side;

whereby, when said boot left and right side attachment members are engaged with said binding left and right side engagement means, and said boot heel attachment member is engaged with said binding heel engagement means, and said binding heel engagement means is in the said closed position, said boot is releasably secured to the binding.

2. The snowboard boot binding system of claim 1, wherein said boot right and left side attachment members are ledge-shaped.

3. The snowboard boot binding system of claim 1, wherein said boot right and left side attachment members are peg-shaped.

4. The snowboard boot binding system of claim 1, wherein said boot lower is rigid from said wide-point portion to said heel portion, and flexible from said toe portion to said wide-point portion, thereby allowing the natural articulation of the foot while walking or hiking.

* * * * *